US010201215B2

(12) United States Patent
Xu

(10) Patent No.: US 10,201,215 B2
(45) Date of Patent: Feb. 12, 2019

(54) COMPOSITE PULL TAB AND ZIPPER APPLYING SAME

(71) Applicant: KEE (GUANGDONG) GARMENT ACCESSORIES LIMITED, Foshan (CN)

(72) Inventor: Xipeng Xu, Foshan (CN)

(73) Assignee: KEE (GUANGDONG) GARMENT ACCESSORIES LIMITED, Foshan (CN)

( * ) Notice: Subject to any disclaimer, the term of this patent is extended or adjusted under 35 U.S.C. 154(b) by 63 days.

(21) Appl. No.: 15/598,289

(22) Filed: May 17, 2017

(65) Prior Publication Data

US 2018/0078006 A1 Mar. 22, 2018

(30) Foreign Application Priority Data

Sep. 21, 2016 (CN) ..... 2016 2 1068178 U

(51) Int. Cl.

| | |
|---|---|
| ***A44B 19/26*** | (2006.01) |
| ***A44B 17/00*** | (2006.01) |
| ***A44B 19/48*** | (2006.01) |
| *A44B 19/28* | (2006.01) |

(52) U.S. Cl.

CPC ..... *A44B 19/262* (2013.01); *A44B 17/0094* (2013.01); *A44B 19/48* (2013.01); *A44B 19/285* (2013.01)

(58) Field of Classification Search

CPC ... A44B 19/262; A44B 17/0094; A44B 19/48; A44B 19/285

See application file for complete search history.

(56) References Cited

U.S. PATENT DOCUMENTS

| | | | | |
|---|---|---|---|---|
| 6,035,497 | A * | 3/2000 | Jackson | A44B 19/262 24/3.4 |
| 6,654,989 | B2 * | 12/2003 | Hamai | A41F 1/008 24/38 |
| 6,804,867 | B2 * | 10/2004 | Oda | A44B 19/26 24/429 |
| 8,931,145 | B1 * | 1/2015 | Liao | A44B 19/262 24/429 |

* cited by examiner

*Primary Examiner* — Robert Sandy

(74) *Attorney, Agent, or Firm* — Wayne & Ken, LLC; Tony Hom

(57) ABSTRACT

A composite pull tab and a zipper applying same. The pull tab includes two metal decoration parts spaced from each other, namely a first metal decoration part and a second metal decoration part; connecting through holes are respectively provided on an inner leg portions of the two metal decoration parts; an electrostatic eliminating unit is electrically connected between the inner leg portions of the two metal decoration parts; the pull tab further comprises a plastic encapsulation part; the plastic encapsulation part is welded on the inner leg portions of the two metal decoration parts and fills the connecting through holes so as to fixedly connect the two metal decoration parts as a whole; the electrostatic eliminating unit is accommodated in the plastic encapsulation part; and outer leg portions of the two metal decoration parts are respectively exposed outside the plastic encapsulation part.

9 Claims, 8 Drawing Sheets

COMPOSITE PULL TAB AND ZIPPER APPLYING SAME

TECHNICAL FIELD

The present invention relates to a composite pull tab, and further relates to a zipper applying the composite pull tab.

BACKGROUND OF THE INVENTION

A human body is very easy to produce static electricity in dry conditions; and especially in autumn and winter, the static electricity is very easy to be accumulated on the human body and clothing due to dry climate, wearing of chemical fiber clothing, friction and other reasons. When the discharge voltage is relatively low, e g., less than 3 KV, people are not aware of a release process of the static electricity. However, when the voltage is relatively high, e.g., greater than 8 KV, arc sparks may appear, so the human body is generally not easy to perceive trace static electricity; but after the static electricity reaches a certain degree, the human body is easy to get an electric shock when contacting with metal articles or other people, thereby making people distressed and helpless.

In view of the above problems, portable electrostatic eliminating accessories for eliminating the static electricity emerge at the right moment. For example, an antistatic key buckle is disclosed in a China utility model patent 201520064990.5; the antistatic key buckle comprises a key buckle chain 1 and a metal cylinder 2; a bottom end of the key buckle chain 1 is connected with one end of the metal cylinder 2; the other end of the metal cylinder 2 is connected with one end of connecting a plastic cylinder 4; the other end of the plastic cylinder 4 is connected with a conical base of a conical metal head 7; a light emitting lamp 5 is provided in the plastic cylinder 4; a first connecting electrode 3 and a second connecting electrode 6 are respectively provided at both ends of the light emitting lamp 5; the first connecting electrode 3 is in contact with one end of the metal cylinder 2; and the second connecting electrode 6 is in contact with the conical base of the conical metal head 7. The antistatic key buckle has simple structure and low production cost, plays a role of decoration, and can also effectively achieve a purpose of releasing the static electricity.

SUMMARY OF THE INVENTION

The antistatic key buckle disclosed in the above-mentioned patent 201520064990.5 is generally strung with key chains for daily use, so that people can carry the antistatic key buckle when carrying keys; but people are not accustomed to carrying the keys all the time at home or during outdoor activities according to living habits, and even if the keys are carried, they are only put in a handbag, so it is not convenient to eliminate the static electricity with an electrostatic eliminating unit on the antistatic key buckle at any time The antistatic key buckle is poor in wear inconvenience, so it is not a preferred matching way that the electrostatic eliminating unit is matched on the antistatic key buckle, which may affect the use experience of the electrostatic eliminating unit.

In view of shortcomings of the prior art, we propose a novel electrostatic eliminating unit carrying way, in which the electrostatic eliminating unit is combined to a pull tab of a clothing zipper so that the electrostatic eliminating unit can be carried as long as the clothing is worn; and the pull tab is exposed outside the clothing and is convenient for a human hand to contact at any time so as to eliminate the static electricity. In such a carrying way, the pull tab needs to be washed together with the clothing in a washing machine and be agitated with the clothing, so that the pull tab needs to have certain structural strength against torque force and friction force applied by liquid or the clothing in an agitating process as well as pulling force during use, and also needs to have good water tightness for preventing the liquid from infiltrating into the pull tab to damage the electrostatic eliminating unit At present, antistatic accessories on the market absolutely cannot meet the above requirements due to looseness of structure.

In view of this, the present invention aims at improving the structure of the pull tab so that the pull tab not only can accommodate the electrostatic eliminating unit, but also has excellent structural strength and water tightness, thereby well combining the electrostatic eliminating unit to the pull tab. The present invention proposes a composite pull tab, wherein the pull tab comprises two metal decoration parts spaced from each other, namely a first metal decoration part and a second metal decoration part; connecting through holes are respectively formed in inner leg portions of the two metal decoration parts; an electrostatic eliminating unit is electrically connected between the inner leg portions of the two metal decoration parts; the pull tab further comprises a plastic encapsulation part; the plastic encapsulation part is welded on the inner leg portions of the two metal decoration parts and fills the connecting through holes so as to fixedly engage the two metal decoration parts as a whole; the electrostatic eliminating unit is accommodated in the plastic encapsulation part, and outer leg portions of the two metal decoration parts are respectively exposed outside the plastic encapsulation part.

Wherein, the two metal decoration parts are spaced from each other means that a certain distance is kept between the two metal decoration parts so that the two metal decoration parts are not subjected to direct contact conduction.

Wherein, the electrostatic eliminating unit is also electrically connected between the inner leg portions of the two metal decoration parts so that static electricity on a human body is conducted to the electrostatic eliminating unit through the metal decoration parts when a human hand touches one of the metal decoration parts, and power consumption is realized by the electrostatic eliminating unit, thereby removing the static electricity on the human body.

Wherein, the inner leg portions and the outer leg portions of the metal decoration parts are named after their relative directions; and a side leg portion which is close to and encapsulated into the plastic encapsulation part is named as the inner leg portion, while the opposite one is named as the outer leg portion.

Wherein, the plastic encapsulation part is welded on the inner leg portions of the two metal decoration parts and fills the connecting through holes so as to fixedly connect the two metal decoration parts as a whole; the above features define a connection relationship between the plastic encapsulation part and each of the two metal decoration parts; the plastic encapsulation part becomes an intermediate connecting part for fixedly connecting the two metal decoration parts into a whole; and the two metal decoration pans cannot be easily split after fixedly connected as a whole, unless subjected to destructive split. In addition, the above features also define a connection process between the plastic encapsulation part and each metal decoration part; during manufacture, the plastic encapsulation part is integrally molten in a heating manner, or part of components of the plastic encapsulation part, e.g., a base discussed below, is molten and placed between the two metal decoration parts and fills the connecting through holes; and the inner leg portions of the metal decoration parts are tightly connected together by means of plasticity of plastics after the plastic encapsulation part or part of the components is cooled.

A further technical solution is as follows: the inner leg portions of the metal decoration parts comprise left inner support legs and right inner support legs respectively provided on the left and the right, as well as transverse support legs connected between the left inner support legs and the right inner support legs; and the connecting through holes are respectively formed in the left inner support legs, the right inner support legs and the transverse support legs, thereby further enhancing connection strength and connection stability between each metal decoration part and the plastic encapsulation part.

Wherein, the electrostatic eliminating unit is accommodated in the plastic encapsulation part, thereby encapsulating and protecting the electrostatic eliminating unit by means of the plastic encapsulation part. In order that the electrostatic eliminating unit is provided in the plastic encapsulation part as middle as possible and is not protruded from a surface of the plastic encapsulation part to affect the appearance and the electrostatic eliminating effect of the pull tab, the following technical solutions can further be adopted:

The first solution is as follows: the plastic connecting body for wrapping the electrostatic eliminating unit is welded between the inner leg portions of the two metal decoration parts in advance; and the plastic encapsulation part is welded and wrapped on the plastic connecting body, thereby fixing the electrostatic eliminating unit first by means of the plastic connecting body so as to ensure that the electrostatic eliminating unit is provided away from the surface of the plastic encapsulation part and is not protruded from the surface of the plastic encapsulation part.

The second solution is as follows: the plastic encapsulation part comprises the base and an upper cover fixedly connected to the base, the base is welded on the inner leg portions of the two metal decoration parts; an electrical accommodation cavity for accommodating the electrostatic eliminating unit and small pits penetrating through the inner leg portions of the metal decoration parts are formed in the base; the small pits are formed beside the electrical accommodation cavity; the electrostatic eliminating unit is electrically connected with the inner leg portions of the metal decoration parts through the small pits, and the upper cover seals the electrical accommodation cavity and the small pits. Further, small convex columns adapted to the small pits are provided on the upper cover.

The third solution is as follows the electrostatic eliminating unit comprises a circuit board and a power consuming element printed on the circuit board; slots with opposite notches are respectively formed in roughly middle positions of the inner leg portions of the two metal decoration parts from a direction in which the thicknesses of metal decoration pans are observed; both ends of the circuit board are respectively inserted into the slots of the two metal decoration parts, thereby positioning the circuit board by means of the slots and avoiding biasing in a process of manufacturing the plastic encapsulation part; and the circuit board is also electrically connected with the metal decoration parts after both ends of the circuit board are respectively inserted into the slots of the metal decoration parts.

According to the above-mentioned technical solutions, compared with the prior art, the present invention has beneficial effects that the plastic encapsulation part is welded on the inner leg portions of the two metal decoration parts and fills the connecting through holes so as to fixedly connect the two metal decoration parts into a whole so that the plastic encapsulation part tightly connects the inner leg portions of the metal decoration parts by means of the plasticity of the plastics; and the plastic encapsulation part and the connecting through holes are combined to hinder the metal decoration parts from separating from the plastic encapsulation part so that the plastic encapsulation part and the two metal decoration parts have excellent structural strength and structural stability, and the metal decoration parts cannot be separated from the plastic encapsulation part even if the pull tab is pulled on the zipper for long term. In addition, the plastic encapsulation part is welded together with the metal decoration parts so that excellent water tightness is formed between the plastic encapsulation part and each metal decoration part, thereby preventing the liquid from infiltrating into the plastic encapsulation part to damage the electrostatic eliminating unit, greatly simplifying a sealing structure between the plastic encapsulation part and each metal decoration part, and improving sealing stability between the plastic encapsulation part and each metal decoration part.

A further technical solution is as follows: an outer leg portion of a first metal decoration part is provided with a first through hole for engaging a slider of a zipper.

A further technical solution is as follows: a second through hole is formed in the outer leg portion of a second metal decoration part so that the second through hole can become a hollow pattern on the second metal decoration part and can also become a gripping portion of the second metal decoration part, thereby conveniently applying the pulling force to the pull tab.

A further technical solution is as follows: the electrostatic eliminating unit comprises the power consuming element; the power consuming element is a luminous body; and a light-transmitting region provided to correspond to the luminous body is provided on the plastic encapsulation part so that the luminous body can emit light and consume electrostatic energy when the static electricity of the human body flows through the luminous body, and a user can also learn about consumption conditions of the static electricity through lighting conditions of the luminous body.

The present invention also proposes a zipper applying the above composite pull tab, wherein the zipper comprises the composite pull tab and a slider capable of being slidably provided on a pair of zipper tapes, and the composite pull tab is connected on the slider.

The present invention is applicable to the composite pull tab requiring an electrostatic eliminating function and the zipper applying the composite pull tab due to the above characteristics and advantages.

DETAILED DESCRIPTION OF THE INVENTION

Structures of a composite pull tab applying technical solutions of the present invention and a zipper applying the composite pull tab are further described below in combination with drawings.

Figure 1:
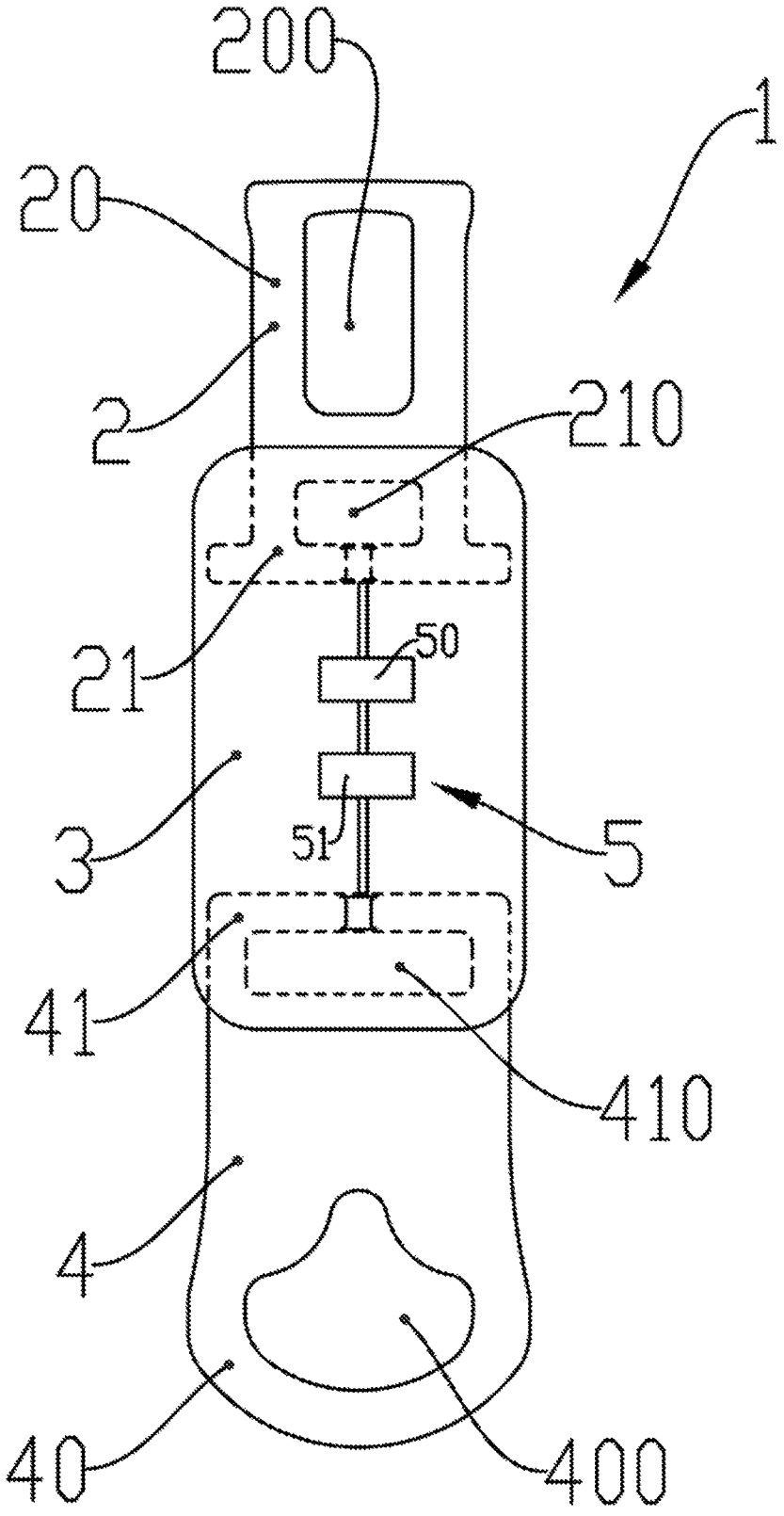
FIG. 1 is a front structural schematic diagram of a pull tab 1 applying a technical solution of the present invention.
Figure 2:
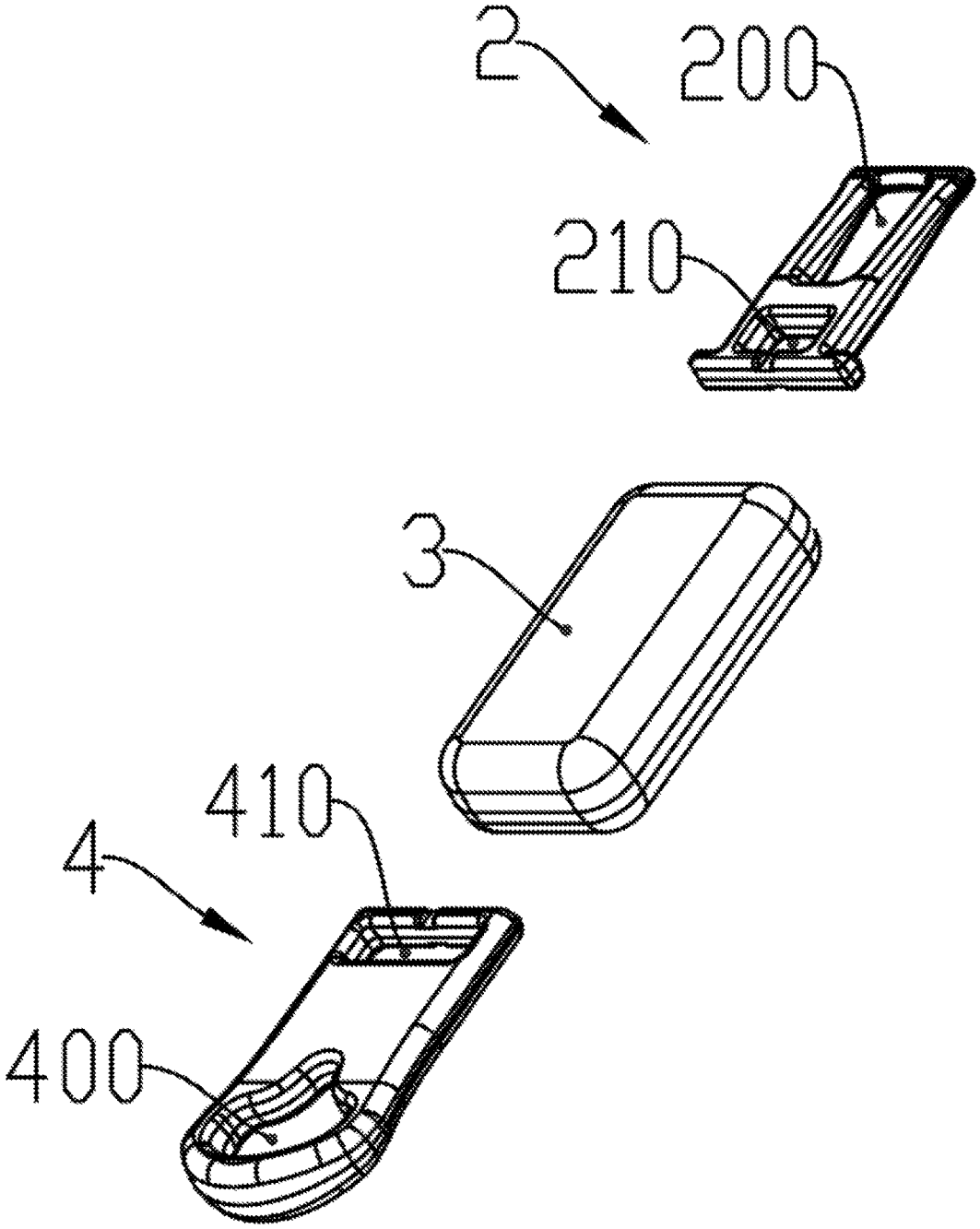
FIG. 2 is a schematic diagram of a breakdown structure of a pull tab 1 shown in FIG. 1.
Figure 3:
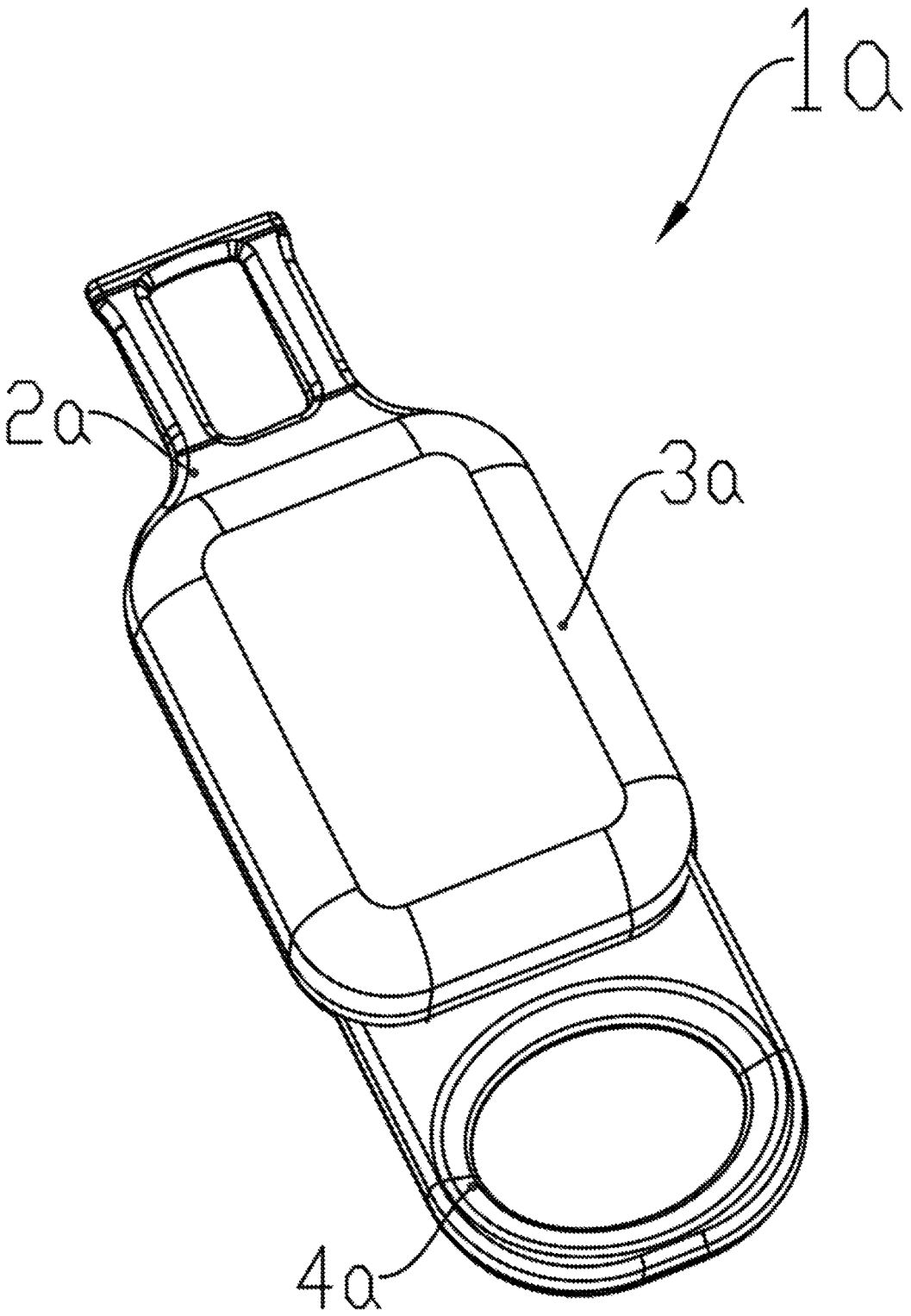
FIG. 3 is a three-dimensional structural schematic diagram of a pull tab 1*a* applying a second embodiment of the present invention.

As shown in FIG. 1 and FIG. 2, the present invention proposes a composite pull tab 1, wherein the pull tab 1 comprises two metal decoration parts (2, 4) spaced from each other, namely a first metal decoration part 2 and a second metal decoration part 4; and a certain distance is kept between the first metal decoration part 2 and the second metal decoration pan 4 so that the two metal decoration parts are not subjected to direct contact conduction. A connecting through hole 210 is formed in an inner leg portion 21 of the first metal decoration part 2; a connecting through hole 410 is formed in an inner leg portion 41 of the second metal decoration part 4; and an electrostatic eliminating unit 5 is electrically connected between the inner leg portions of the two metal decoration parts (2, 4) so that static electricity on a human body is conducted to the electrostatic eliminating unit 5 through the metal decoration part (2 or 4) when a human hand touches one metal decoration part (2 or 4), and power consuming is realized by the electrostatic eliminating unit 5, thereby removing the static electricity on the human body, wherein the inner leg portions and the outer leg portions of the metal decoration parts (2, 4) are named after their relative directions; and a side leg portion which is close to and encapsulated into the plastic encapsulation part 3 is named as the inner leg portion, while the opposite one is named as the outer leg portion.

The pull tab 1 further comprises a plastic encapsulation part 3; the plastic encapsulation part 3 is welded on the inner leg portion 21 of the first metal decoration part 2 and the inner leg portion 41 of the second metal decoration part 4 and fills the connecting through holes (210, 410) so as to fixedly connect the two metal decoration parts (2, 4) into a whole; the electrostatic eliminating unit 5 is accommodated in the plastic encapsulation part 3; and an outer leg portion 20 of the first metal decoration part 2 and an outer leg portion 40 of the second metal decoration part 4 are respectively exposed outside the plastic encapsulation part 3.

Wherein, the plastic encapsulation part 3 is welded on the inner leg portion 21 of the first metal decoration part 2 and the inner leg portion 41 of the second metal decoration part 4 and fills the connecting through holes (210, 410) so as to fixedly connect the two metal decoration parts (2, 4) into a whole; the above features define a connection relationship between the plastic encapsulation part 3 and each of the two metal decoration parts (2, 4); the plastic encapsulation part 3 is an intermediate connecting part for fixedly engaging the two metal decoration parts (2, 4) into a whole; and the two metal decoration parts cannot be easily split after fixedly connected into a whole, unless subjected to destructive split. In addition, the above features also define a connection process between the plastic encapsulation part 3 and each of the metal decoration parts (2, 4); during manufacture, the plastic encapsulation part 3 is integrally molten in a heating manner, is placed between the two metal decoration parts (2, 4) and fills the connecting through holes (210, 410); the inner leg portions of the metal decoration parts (2, 4) are tightly connected together by means of plasticity of plastics after the plastic encapsulation part 3 is cooled; and the plastic encapsulation part 3 and the connecting through holes (210, 410) are combined to hinder the metal decoration parts (2, 4) from separating from the plastic encapsulation part 3 so that the plastic encapsulation part 3 and the two metal decoration parts (2, 4) have excellent structural strength and structural stability, and the metal decoration parts (2, 4) cannot be separated from the plastic encapsulation part 3 even if the pull tab 1 is pulled on the zipper for long term. In addition, the plastic encapsulation part 3 is welded together with the metal decoration parts (2, 4) so that excellent water tightness is formed between the plastic encapsulation part 3 and each of the metal decoration parts (2, 4), thereby preventing the liquid from infiltrating into the plastic encapsulation part 3 to damage the electrostatic eliminating unit 5, greatly simplifying a sealing structure between the plastic encapsulation part 3 and each of the metal decoration parts (2, 4), and improving sealing stability between the plastic encapsulation part 3 and each of the metal decoration parts (2, 4).

As shown in FIG. 1, an outer leg portion of the first metal decoration part 2 is provided with a first through hole 200 for engaging a slider of a zipper; and an outer leg portion of a second metal decoration part 4 is provided with a second through hole 400 so that the second through hole 400 can become a hollow pattern on the second metal decoration part 4 and can also become a gripping portion of the second metal decoration part 4, thereby conveniently applying pulling force to the pull tab 1.

The electrostatic eliminating unit 5 comprises the power consuming element and a conducting wire; the power consuming element comprises a luminous body 50 and a resistor 51; and a light-transmitting region provided to correspond to the luminous body is provided on the plastic encapsulation part 3 so that the luminous body 50 can emit light and consume electrostatic energy when the static electricity of the human body flows through the luminous body, and a user can also learn about consumption conditions of the static electricity through lighting conditions of the luminous body.

In order that the electrostatic eliminating unit 5 is provided in the plastic encapsulation part 3 as middle as possible and is not protruded from a surface of the plastic encapsulation part 3 due to biasing to affect the appearance and electrostatic eliminating effect of the pull tab 1, the following technical solutions can further be adopted:

In a first embodiment, the structure of the present embodiment is similar to the structures shown in FIG. 1 and FIG. 2, thereby omitting a specific view. The plastic connecting body for wrapping the electrostatic eliminating unit 5 is welded between the inner leg portions of the two metal decoration parts (2, 4) in advance; and the plastic encapsulation part 3 is welded and wrapped on the plastic connecting body, thereby fixing the electrostatic eliminating unit 5 first by means of the plastic connecting body so as to ensure that the electrostatic eliminating unit is provided away from the surface of the plastic encapsulation part 3 and is not protruded from the surface of the plastic encapsulation part 3.

In a second embodiment, the structure of the pull tab 1 shown in FIG. 1 and FIG. 2 is appropriately improved in the present embodiment; the specific structure is shown in FIG. 3, FIG. 4, FIG. 5 and FIG. 6; in order to facilitate discussion, the pull tab applying the second embodiment is labeled as the pull tab 1*a*; and the structure of the pull tab 1*a* is similar to that of the pull tab 1. Main differences between the pull tab 1*a* and the pull tab 1 are discussed below.

Figure 4:
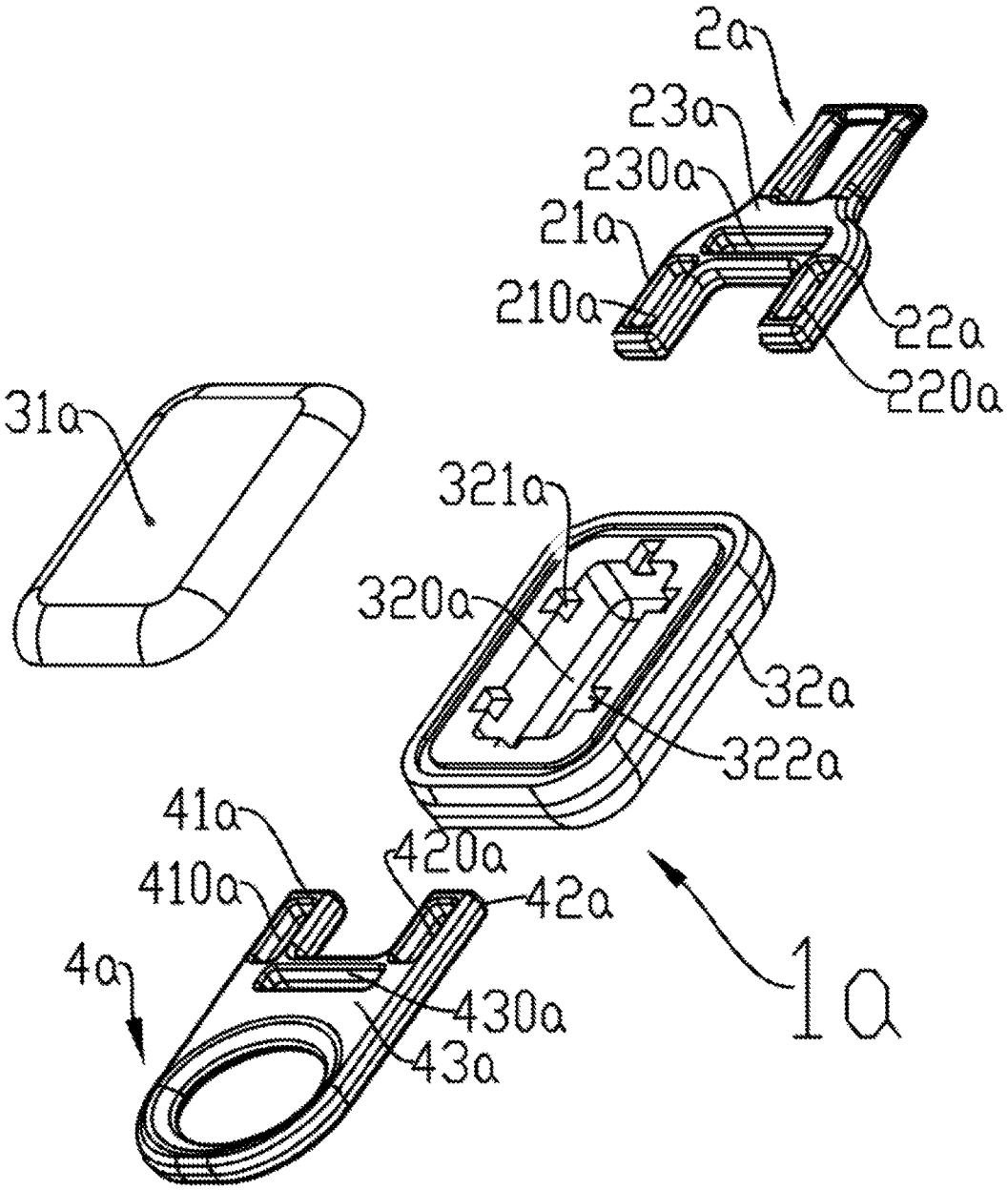
FIG. 4 is a schematic diagram of a breakdown structure of a pull tab 1*a* shown in FIG. 3.
Figure 5:
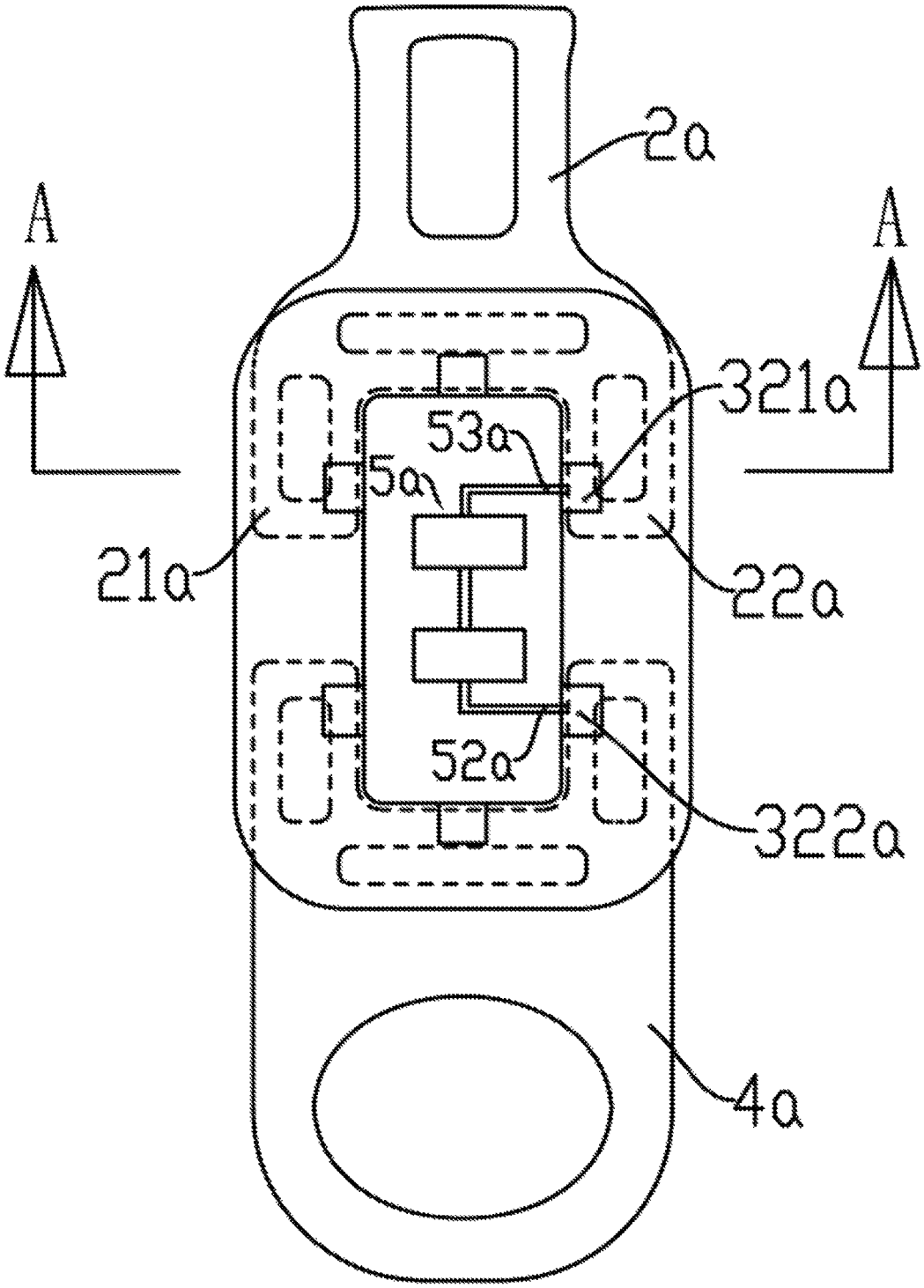
FIG. 5 is a front structural schematic diagram of a pull tab 1*a* shown in FIG. 3 in which inner leg portions of the metal decoration parts are wrapped in a plastic encapsulation part and are indicated by dotted lines.

As shown in FIG. 4, the inner leg portion of a first metal decoration part 2*a* comprises a left inner support leg 21*a* and a right inner support leg 22*a* respectively provided on the left and the right, as well as a transverse support leg 23*a* connected between the left inner support leg 21*a* and the right inner support leg 22*a*; and the connecting through holes (210*a*, 220*a*, 230*a*) are respectively formed in the left inner support leg 21*a*, the right inner support leg 22*a* and the transverse support leg 23*a*. Similarly, the inner leg portion of a second metal decoration part 4*a* comprises a left inner support leg 41*a* and a right inner support leg 42*a* respectively provided on the left and the right, as well as a transverse support leg 43*a* connected between the left inner support leg 41*a* and the right inner support leg 42*a*; and the connecting through holes (410*a*, 420*a*, 430*a*) are respectively formed in the left inner support leg 41*a*, the right inner support leg 42*a* and the transverse support leg 43*a*, thereby further enhancing connection strength and connection stability between each of the metal decoration parts (2*a*, 4*a*) and a plastic encapsulation part 3*a*.

The plastic encapsulation part 3*a* in the present embodiment adopts a split structure, the plastic encapsulation part 3*a* comprises a base 32*a* and an upper cover 31*a* fixedly connected to the base 32*a*; the base 32*a* is welded on the inner leg portions (21*a*. 41*a*) of the two metal decoration parts (2*a*, 4*a*) and fills the connecting through holes; an electrical accommodation cavity 320*a* for accommodating an electrostatic eliminating unit 5*a* and a plurality of small pits (321*a*, 322*a*) penetrating through the inner leg portions of the metal decoration parts (2*a*, 4*a*) are formed in the base 32*a*; specifically, two small pits 321*a* respectively penetrate through the left inner support leg 21*a* and the right inner support leg 22*a* of the first metal decoration part 2*a*, and two small pits 322*a* respectively penetrate through the left inner support leg 41*a* and the right inner support leg 42*a* of the second metal decoration part 4*a*. The small pits (321*a*, 322*a*) are provided beside the electrical accommodation cavity 320*a*, a head conducting wire 53*a* of the electrostatic eliminating unit 5*a* is electrically connected with the inner leg portion 22*a* of the first metal decoration part 2*a* through the small pit 321*a* on the right; and a tail conducting wire 52*a* of the electrostatic eliminating unit 5*a* is electrically connected with the inner leg portion 42*a* of the second metal decoration part 4*a* through the small pit 322*a* on the right, thereby positioning the electrostatic eliminating unit 5*a* by means of the base 32*a*, and avoiding that the electrostatic eliminating unit 5*a* is protruded from the surface of the plastic encapsulation part 3 due to biasing to affect the appearance and electrostatic eliminating effect of the pull tab 1.

Figure 6:
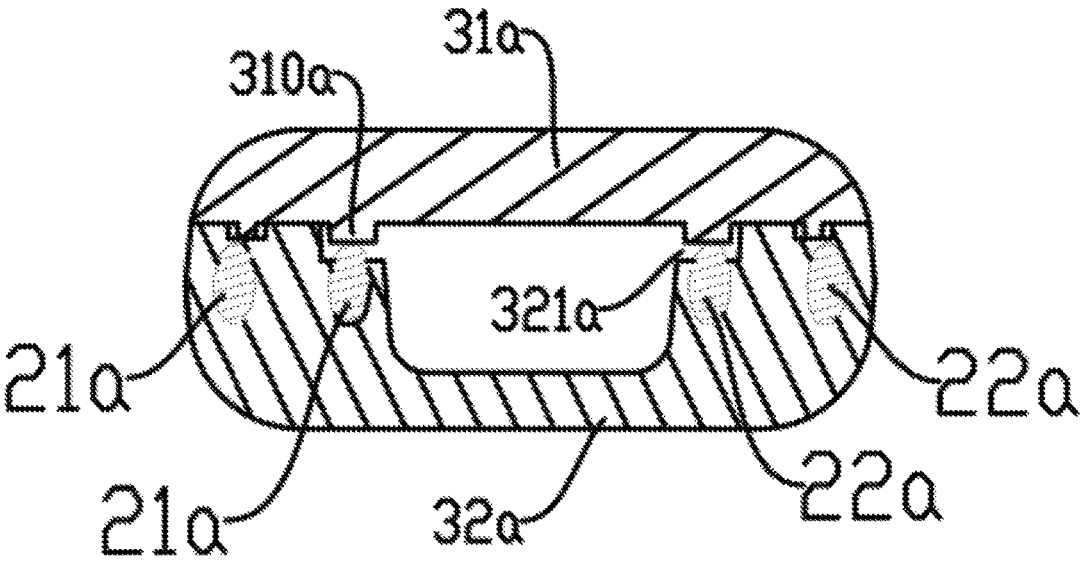
FIG. 6 is a cross-sectional structural schematic diagram of a direction A-A in FIG. 5.

As shown in FIG. 6, small convex columns 310*a* adapted to the small pits (321*a*, 322*a*) are provided on the upper cover 31*a*; the upper cover 31*a* seals the electrical accommodation cavity 320*a* and upper pits (321*a*, 322*a*); and the small convex columns 310*a* extend into the small pits (321*a*, 322*a*). The upper cover 31*a* can be fixedly connected with the base 32*a* through ultrasonic welding, glue adhesion or other processes so that the upper cover 31*a* can well seal the electrical accommodation cavity 320*a* and the upper pits (321*a*, 322*a*) and prevent the liquid from infiltrating into the base 32*a* to damage the electrostatic eliminating unit 5*a*.

Figure 7:
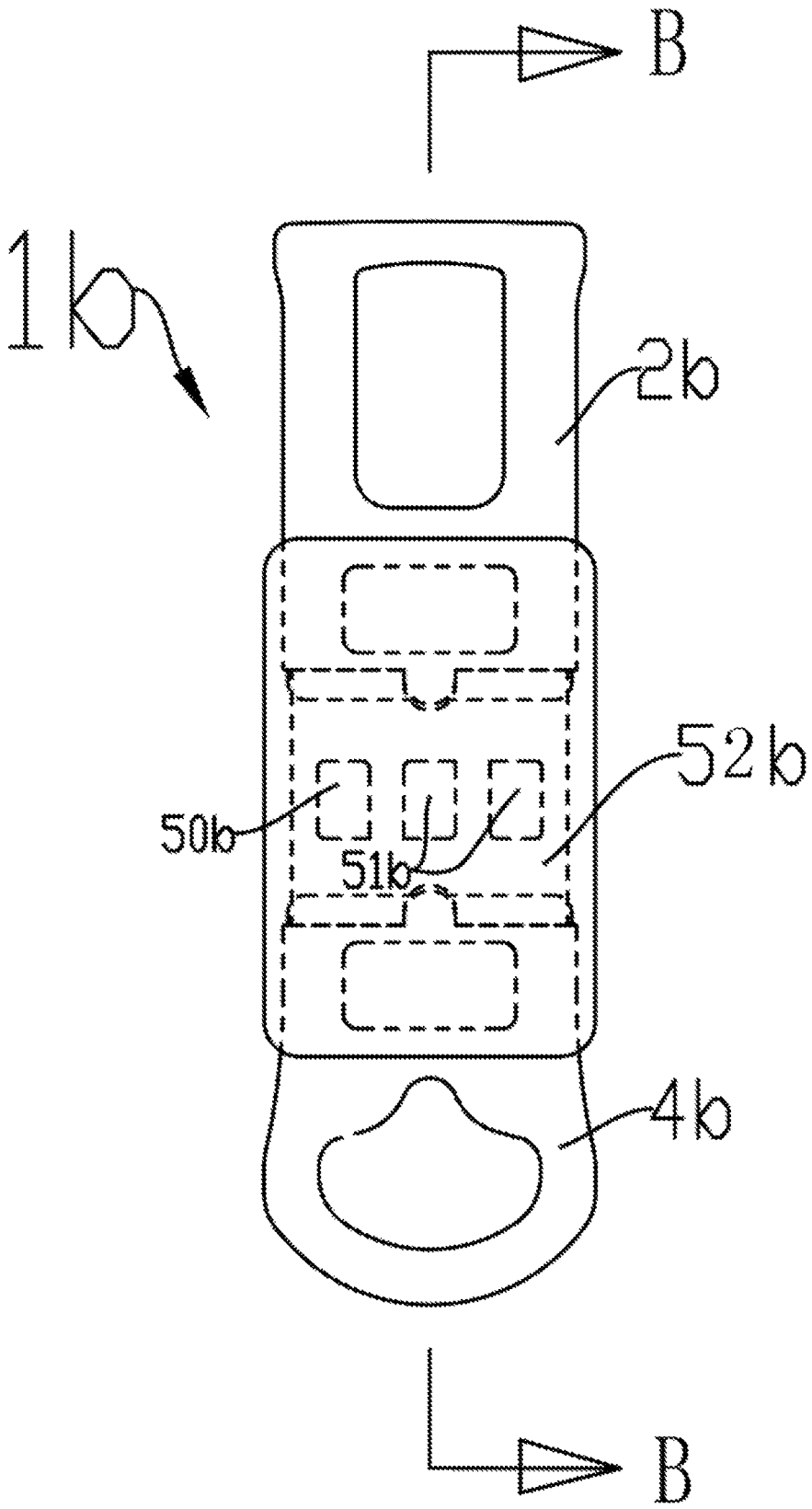
FIG. 7 is a structural schematic diagram of a pull tab 1*b* applying a third embodiment of the present invention.
Figure 8:
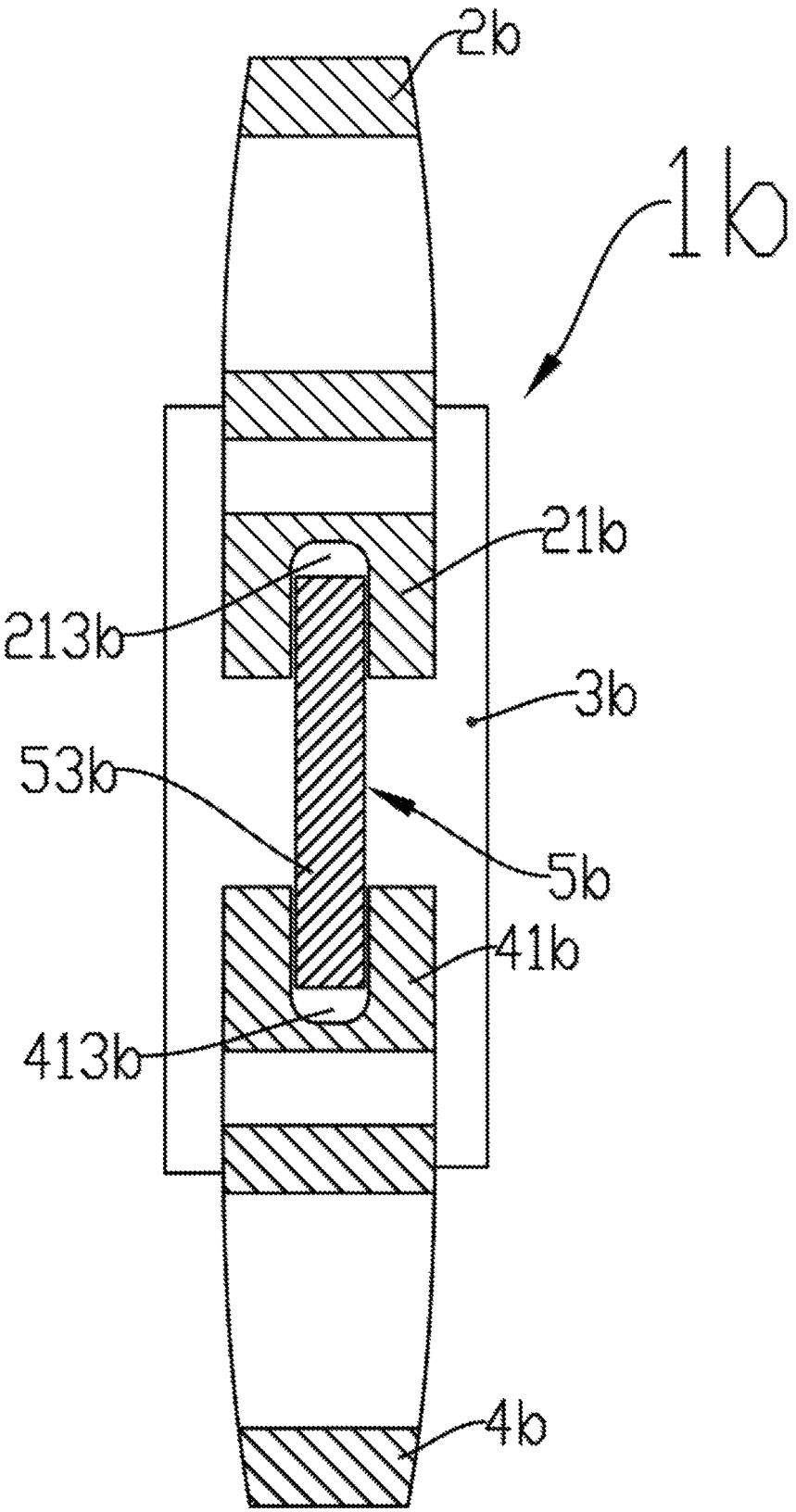
FIG. 8 is a cross-sectional structural schematic diagram of a direction B-B shown in FIG. 7, in which the shown observation direction is a direction in which thicknesses of metal decoration parts are observed.

In a third embodiment, the structure of the pull tab 1 shown in FIG. 1 and FIG. 2 is appropriately improved, the specific structure is shown in FIG. 7 and FIG. 8; in order to facilitate discussion, the pull tab applying the third embodiment is labeled as the pull tab 1*b*; and the structure of the pull tab 1*b* is similar to that of the pull tab 1. Main differences between the pull tab 1*b* and the pull tab 1 are discussed below.

As shown in FIG. 7 and FIG. 8, an electrostatic eliminating unit 5*b* comprises a circuit board 52*b*; and a luminous body 50*b* and a resistor 51*b* are printed on the circuit board 52*b*. Slots (213*b*, 413*b*) with opposite notches are respectively formed in roughly middle positions of the inner leg portions of the two metal decoration parts (2*b*, 4*b*) from a direction in which thicknesses of the metal decoration parts (2*b*, 4*b*) are observed; both ends of the circuit board 52*b* are respectively inserted into the slots (213*b*, 413*b*) of the two metal decoration parts (2*b*, 4*b*), thereby fixing the position of the circuit board 52*b* by means of the slots (213*b*, 413*b*) and avoiding that the electrostatic eliminating unit 5 is protruded from the surface of the plastic encapsulation part 3*b* due to biasing to affect the appearance and electrostatic eliminating effect of the pull tab 1*b*; and the circuit board 52*b* is also electrically connected with the metal decoration parts (2*b*, 4*b*) after both ends of the circuit board 52*b* are respectively inserted into the slots (213*b*, 413*b*) of the metal decoration parts (2*b*, 4*b*).

The present invention also proposes a zipper applying the composite pull tab (1, 1*a*, 1*b*); the zipper comprises the composite pull tab (1 or 1*a* or 1*b*) and a slider capable of being slidably provided on a pair of zipper tapes, and the composite pull tab (1, 1*a* or 1*b*) is connected on the slider.

The present invention is applicable to the composite pull tab (1 or 1*a* or 1*b*) requiring an electrostatic eliminating function and the zipper applying the composite pull tab due to the above characteristics and advantages.

What is claimed is:

1. A composite pull tab, wherein the pull tab comprises two metal decoration parts spaced from each other, namely a first metal decoration part and a second metal decoration part; connecting through holes are respectively provided on an inner leg portions of the two metal decoration parts; an electrostatic eliminating unit is electrically connected between the inner leg portions of the two metal decoration parts; the pull tab further comprises a plastic encapsulation part; the plastic encapsulation part is welded on the inner leg portions of the two metal decoration parts and fills the connecting through holes so as to fixedly connect the two metal decoration parts as a whole; the electrostatic eliminating unit is accommodated in the plastic encapsulation part; and outer leg portions of the two metal decoration parts are respectively exposed outside the plastic encapsulation part.

2. The composite pull tab according to claim 1, wherein the plastic encapsulation part comprises a base and an upper cover fixedly connected to the base; the base is welded on the inner leg portions of the two metal decoration parts; an electrical accommodation cavity for accommodating the electrostatic eliminating unit and small pits penetrating through the inner leg portions of the metal decoration parts are provided on the base; the small pits are formed beside the electrical accommodation cavity; the electrostatic eliminating unit is electrically connected with the inner leg portions of the metal decoration parts through the small pits; and the upper cover seals the electrical accommodation cavity and the small pits.

3. The composite pull tab according to claim 2, wherein the upper cover is provided with small convex columns adapted to the small pits.

4. The composite pull tab according to claim 1, wherein the electrostatic eliminating unit comprises a circuit board and power consuming elements printed on the circuit board; slots with opposite notches are respectively provided in roughly middle position of the inner leg portions of the two metal decoration parts from a direction of observing the thicknesses of the metal decoration parts; and both ends of the circuit board are respectively inserted into the slots of the two metal decoration parts.

5. The composite pull tab according to claim 1, wherein a first through hole for engaging a slider of a zipper is formed in the outer leg portion of the first metal decoration part.

6. The composite pull tab according to claim 5, wherein a second through hole is provided in the outer leg portion of the second metal decoration part.

7. The composite pull tab according to claim 1, wherein the electrostatic eliminating unit comprises a power consuming element; the power consuming element is a luminous body; and a light-transmitting region corresponding to the luminous body is provided on the plastic encapsulation part.

8. The composite pull tab according to claim 1, wherein the inner leg portions of the metal decoration parts comprise left inner support legs and right inner support legs respectively provided on their left and right sides thereof, as well as transverse support legs connected between the left inner support legs and the right inner support legs; and the connecting through holes are respectively formed in the left inner support legs, the right inner support legs and the transverse support legs.

9. A zipper, comprising the composite pull tab of claim 1 and a slider capable of being slidably provided on a pair of zipper tapes, wherein the composite pull tab is connected on the slider.

* * * * *